US006802140B2

(12) United States Patent
Aslanides

(10) Patent No.: US 6,802,140 B2
(45) Date of Patent: Oct. 12, 2004

(54) SHOE AND METHOD FOR DECORATING

(76) Inventor: Lisa Margaret Aslanides, 7021 Sand Point Way NE., B116, Seattle, WA (US) 98115

( * ) Notice: Subject to any disclaimer, the term of this patent is extended or adjusted under 35 U.S.C. 154(b) by 28 days.

(21) Appl. No.: 10/379,009

(22) Filed: Mar. 4, 2003

(65) Prior Publication Data

US 2004/0172855 A1 Sep. 9, 2004

(51) Int. Cl.[7] ..... A43B 23/00
(52) U.S. Cl. ..... 36/136; 36/45; 12/142 R
(58) Field of Search ..... 36/136–137, 45; 12/142 R, 146 C

(56) References Cited

U.S. PATENT DOCUMENTS

| | | | | |
|---|---|---|---|---|
| 1,977,995 A | | 10/1934 | Morali | |
| 2,271,595 A | | 2/1942 | Langendorf | |
| 2,759,284 A | | 8/1956 | Santisi | |
| 2,982,033 A | * | 5/1961 | Bingham, Jr. | 40/636 |
| 3,568,339 A | | 3/1971 | Masaohara et al. | |
| 3,921,313 A | * | 11/1975 | Mahide et al. | 36/4 |
| 4,516,337 A | | 5/1985 | Adamik | |
| 4,899,411 A | | 2/1990 | Johnson et al. | |
| 5,712,005 A | | 1/1998 | Monn | |
| 6,025,064 A | * | 2/2000 | Kawata et al. | 428/304.4 |
| 6,312,782 B1 | | 11/2001 | Goldberg et al. | |
| 2002/0078599 A1 | | 6/2002 | Delgorgue et al. | |

* cited by examiner

*Primary Examiner*—M Patterson
(74) *Attorney, Agent, or Firm*—Polly L. Oliver

(57) ABSTRACT

A Method for Decorating a Shoe is a process whereby a shoe is covered with several layers of an acrylic polymer emulsion gel, which layers may be matte or gloss finish, tinted, or clear. One or more of the polymer gel layers is used to affix onto the shoe various sizes and types of paper and/or other decorative items, and the overall process may make use of elements of collage or decoupage. The basic steps of the decorative process in the preferred embodiment are roughly as follows: the shoe is cleaned; the paper or other decorative items to be affixed are immersed in the polymer gel to coat; the decorative items are applied to the clean shoe, forming a first layer of gel next to the shoe and a second layer of gel on top of the items; and two layers of (typically gloss) gel, which may be tinted, are applied to finish the decorated shoe. In alternate embodiments, three-dimensional decorative items may be applied, or one or more layers of the gel may be shaped and textured so as to enhance the overall design.

20 Claims, 2 Drawing Sheets

SHOE AND METHOD FOR DECORATING

FIELD OF THE INVENTION

This invention pertains generally to methods for decorating items and more specifically to a method for decorating an item of footwear such as a shoe, boot, clog, slipper, or sandal.

BACKGROUND OF THE FIELD

There is a variety of decorated footwear on the market today. However, the styles available are generally limited in color and design. To date, color has been incorporated into footwear at the manufacturing level—either by dying the leather (or other material), using printed fabric (as in U.S. Pat. No. 3,568,339 to Masao Hara et al.), or using precolored plastics or dyed straw.

After the manufacturing process, objects such as rhinestones and applique have been affixed to the footwear, as in U.S. Pat. No. 1,977,995 to Morali, which discloses a method for mounting rhinestones or other metal decorations on a shoe. Moreover, to add decoration to footwear, e.g., shoes and boots, items have been applied in a pocket in the heel or side of the shoe as in U.S. Pat. No. 2,759,284 to Santisi, which discloses an ornament being trapped within a heel pocket of the shoe. Although polymer has been used in some of the prior art patents cited (such as U.S. Pat. No. 5,712,005 to Monn and U.S. patent application Ser. No. US2002/0078599 to Delgorgue et al.), it is used in a strictly utilitarian way, i.e., to waterproof or protect the items.

SUMMARY OF THE INVENTION

The present invention solves the above-mentioned problems by providing a piece of decorated footwear, which in the preferred embodiment is a shoe (but could also be a boot, sandal, slipper, clog, or any other item of footwear with a sole and an upper), such decorated footwear being created by a new method, whereby the area on the surface to be decorated (e.g., the upper, sole, or heel) is covered, after cleaning to remove loose dirt and dust, with one or more layers of an acrylic polymer emulsion gel and various decorative items, which may be two-dimensional or three-dimensional. The acrylic polymer emulsion gel layers are an integral part of the overall design of the decoration and vary according to the design goal, e.g., by thickness, number of coats, or finish—either matte or gloss. Furthermore, one or more of the acrylic polymer emulsion gel layers may be tinted, sculpted, or molded into three-dimensional designs.

One or more of the polymer gel layers is used to affix onto the surface, either interior or exterior, various sizes and types of colored paper and/or other decorative items, e.g., printed matter, photographs, or found objects. The application tool used for these layers also varies according to the design goal and may be, for instance, a brush, a sprayer, or even the artist's fingers, and is generally chosen to accommodate the particular gel used (i.e., the thickness and finish), the types of items being affixed, and the contour of the surface. In the preferred embodiment, the artist's fingers are used to apply at least the first polymer gel layer, allowing that the decorative items will be closely molded to the contoured surface of the shoe.

The first layer of the preferred embodiment is generally a thin polymer gel (gloss or matte finish) used to sufficiently adhere the paper or other decorative items to the clean shoe and to create the first layer of design and protection. (If the decorative items are printed matter, photos, or found objects, then the polymer gel may be a thicker type.) This first layer of polymer gel may be applied separately or it may be formed when the decorative items, having been first immersed in polymer gel, are applied to the clean shoe. If the decorative items have been first immersed in polymer gel, then their application to the shoe forms not only a first polymer gel layer next to the shoe but also a second polymer gel layer on top of the decorative items. After the first layers of polymer gel and decorative items, two additional layers of medium thickness polymer gel are usually applied to cover the area to be decorated. These top layers of polymer gel are chosen for design effect and may be gloss or matte finish, clear or tinted.

In alternate embodiments, one of the top layers of polymer gel can be built-up on the shoe and sculpted to make new designs—either abstract or real. Also, the shoe can be painted, stenciled, or ink stamped on the upper, heel, or sole, either before or after the gel application procedure. In other alternate embodiments, three-dimensional objects—such as beads or found objects—can be applied instead of, or in combination with, two-dimensional objects.

DETAILED DESCRIPTION OF THE PREFERRED EMBODIMENT

Figure 1:
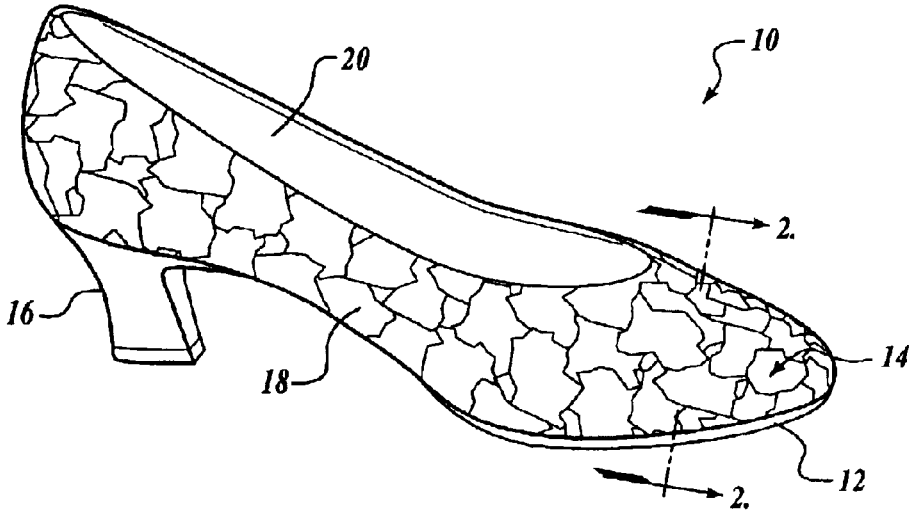
FIG. 1 is a perspective view of the preferred embodiment of the decorated shoe according to the present invention.
Figure 4:
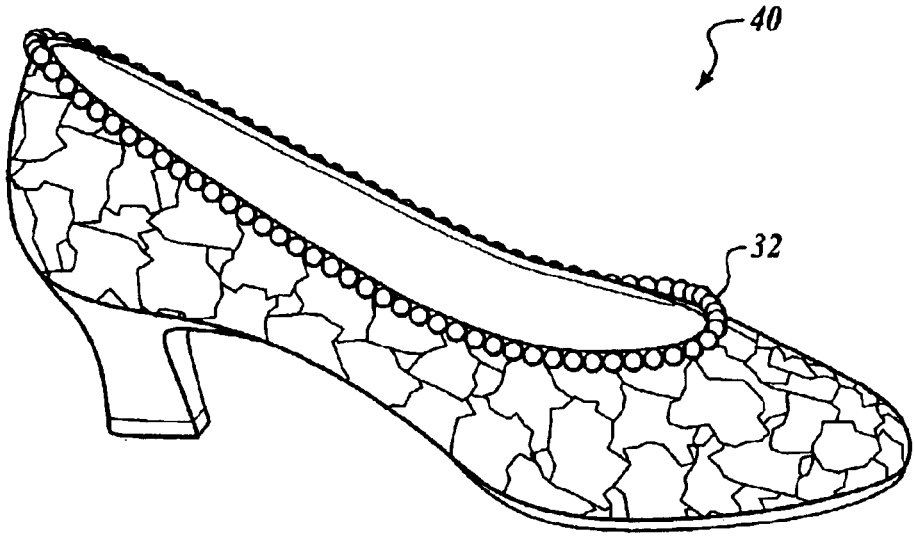
FIG. 4 is a perspective view of an alternate embodiment decorated with three-dimensional decorative items.

FIG. 1 shows a decorated shoe 10 including a sole 12, an upper 14, and a heel 16. (As a heel is not necessary to the invention, alternate embodiments might not include a heel.) The decorative item 18 is an example of the two-dimensional items that may be affixed to the shoe during the decoration process; and in the preferred embodiment, the items 18 are generally planar and generally flexible and may be, eg., smooth or textured paper, photographs, or printed matter. In alternate embodiments, as is shown in FIG. 4, the decorative items need not be planar, but may be three-dimensional items 32. Further, in other alternate embodiments, the interior 20 of the shoe 10 or the heel 16 of the shoe 10, as well as the upper 14, may also be painted, stenciled, stamped, covered in cloth, or decorated according to the present invention.

Figure 2:
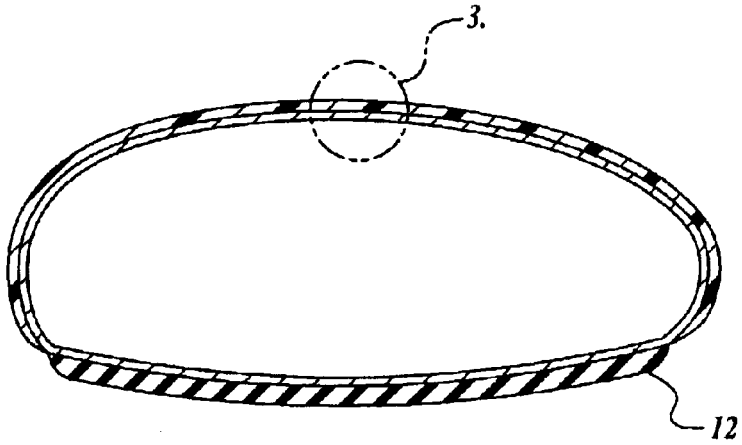
FIG. 2 is a cross-sectional view of the polymer gel layers with affixed decorative items in the preferred embodiment.
Figure 3:
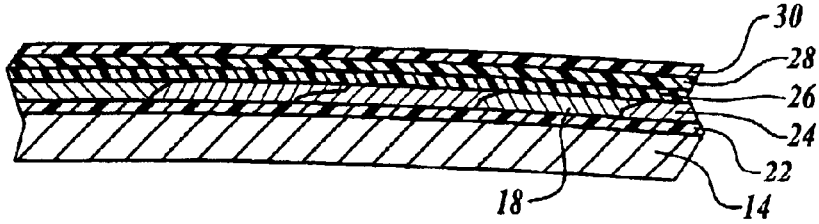
FIG. 3 is a detail view of the polymer gel layers.

FIG. 2 is a cross-sectional view taken across the toe of the shoe 10, and FIG. 3 shows in detail the typical layers according to the present invention. The upper 14 is mounted on the sole 12 and is covered by a first layer 22 of an acrylic polymer emulsion gel. The second layer 24 comprises the decorative items, typified by 18. Because the shoe need not be entirely covered by these decorative items, the second layer 24 may not be contiguous. The third layer 26 is another layer of acrylic polymer emulsion gel (usually a thicker polymer gel layer than the first polymer gel layer).

In the preferred embodiment, the items 18 are applied to the upper 14 with the fingers after having been immersed in the acrylic polymer emulsion gel (thereby simultaneously forming the layers 22, 24, and 26). In this way, the items 18 and the gel layers can be easily smoothed along the contour of the upper 14. In alternate embodiments, the layers of polymer gel can be applied by a brush or sprayer, and smoothed or textured as desired. This third polymer gel layer 26 is covered over in its entirety by at least one, preferably two, layers of polymer gel 28 and 30. The top layers 28 and 30 are typically gloss finish and must be capable of drying in order to waterproof the decorated shoe 10 with a hard, protective coating and to give the decorated shoe a shiny, attractive appearance. To that end, one or both of the gloss gel top layers 28 or 30 can be tinted or stained.

Figure 5:
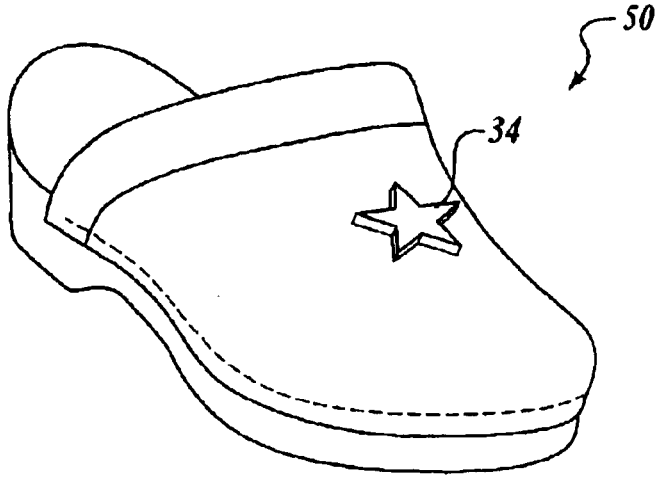
FIG. 5 is a perspective view of an alternate embodiment decorated with a build-up of sculpted polymer gel.

FIG. 4 shows a first alternate embodiment 40 of a decorated shoe having three-dimensional decorative items 32. The three-dimensional decorative items 32 may be adhered to the shoe with a polymer gel layer during or after the afore-mentioned process. FIG. 5 shows a second alternate embodiment 50 having a three-dimensional decorative item 34. In this case, the decorative item 34 is made of sculpted polymer gel and is usually formed by the artist applying a thicker-than-usual polymer gel layer and sculpting such polymer gel with the fingers or other tools.

What is claimed is:

1. A method for decorating a piece of footwear, such piece of footwear including a sole and an upper attached to said sole, comprising the steps of:

cleaning the surface of the upper so as to remove all loose dirt and dust from the area to be decorated;

mounting a plurality of decorative items on the area of the upper to be decorated, such items having been immersed in an acrylic polymer emulsion gel, so that mounting them forms a first layer of acrylic polymer emulsion gel next to the shoe, a layer of decorative items, and a second layer of acrylic polymer emulsion gel on top of the decorative items;

applying a third layer of acrylic polymer emulsion gel to cover the entire decorated area of the upper, such acrylic polymer emulsion gel being capable of drying to form a generally hard protective coating.

2. The method of claim 1 wherein the piece of footwear is chosen from the group comprising shoes, boots, sandals, clogs, and slippers.

3. The method of claim 1 wherein the area to be decorated includes the entire upper of the piece of footwear.

4. The method of claim 1 wherein the decorative items are flexible so as to conform to the surface of the piece of footwear and are generally planar and made of paper.

5. The method of claim 4 wherein the decorative items are chosen from the group comprising tissue paper, printed matter, and photographs.

6. The method of claim 1 wherein the first layer of acrylic polymer emulsion gel is of matte finish and the third layer of acrylic polymer emulsion gel is of gloss finish.

7. The method of claim 1 wherein at least one of the first, second, and third acrylic polymer emulsion gel layers is tinted.

8. The method of claim 1 further comprising the step of applying a plurality of three-dimensional objects to the area of the upper to be decorated.

9. A method for decorating a piece of footwear, such piece of footwear including a sole and an upper mounted on said sole, comprising the steps of:

cleaning the surface of the upper so as to remove all loose dirt and dust from the area to be decorated;

applying a first layer of acrylic polymer emulsion gel directly to the area on the upper to be decorated and smoothing such acrylic polymer emulsion gel layer;

mounting a plurality of decorative items on the area of the upper to be decorated, such items having been immersed in an acrylic polymer emulsion gel for adhesion to the first acrylic polymer emulsion gel layer;

applying a second layer of an acrylic polymer emulsion gel in varying thicknesses and sculpting such second acrylic polymer emulsion gel layer into a textured surface;

applying a third layer of acrylic polymer emulsion gel to cover the entire decorated area of the upper, such third acrylic polymer emulsion gel layer being capable of drying to form a generally hard, protective coating; and drying the acrylic polymer emulsion gel layers so as to provide a hard, protective coating.

10. The method of claim 9 wherein the first layer of acrylic polymer emulsion gel is of matte finish and the third layer of acrylic polymer emulsion gel is of gloss finish.

11. The method of claim 9 wherein the first layer of acrylic polymer emulsion gel is applied and smoothed with fingers.

12. A decorated shoe comprising:

a sole and an upper mounted on said sole; a plurality of decorative items affixed to said upper with an acrylic polymer emulsion gel; and a top layer of acrylic polymer emulsion gel covering said decorative items and dried to form a hard, protective coating.

13. The decorated shoe of claim 12 wherein the decorative items are generally planar and generally flexible and are chosen from the group including tissue paper, printed matter, and photographs and are affixed to the upper.

14. The decorated shoe of claim 12 wherein the decorative items include three-dimensional objects.

15. The decorated shoe of claim 12 wherein the top layer of acrylic polymer emulsion gel is of gloss finish and is tinted.

16. The decorated shoe of claim 12 further comprising a painted heel attached to said sole.

17. The decorated shoe of claim 12 further comprising stenciling.

18. The decorated shoe of claim 12 further comprising an additional layer of acrylic polymer emulsion gel which has been sculpted into a three-dimensional design.

19. A method for decorating a piece of footwear, such piece of footwear including a sole and an upper attached to said sole, comprising the steps of:

cleaning the surface of the upper so as to remove all loose dirt and dust from the area to be decorated;

applying a first layer of acrylic polymer emulsion gel directly to the area of the upper to be decorated and smoothing such layer;

mounting a plurality of decorative items on the first layer of acrylic polymer emulsion gel on the area of the upper to be decorated;

applying a second layer of an acrylic polymer emulsion gel so as to cover the items mounted thereon and smoothing such layer;

applying a third layer of acrylic polymer emulsion gel to cover the entire decorated area of the upper, such acrylic polymer emulsion gel being capable of drying to form a generally hard protective coating.

20. The method of claim 19 further comprising the step of applying a plurality of three-dimensional objects to the area to be decorated.

* * * * *